US005412297A

United States Patent [19]

Clark et al.

[11] Patent Number: 5,412,297

[45] Date of Patent: May 2, 1995

[54] MONITORED RADIO FREQUENCY DOOR EDGE SENSOR

[75] Inventors: John E. Clark, Ann Arbor; James S. Murray, S. Lyon, both of Mich.

[73] Assignee: Stanley Home Automation, Troy, Mich.

[21] Appl. No.: 265,761

[22] Filed: Jun. 27, 1994

[51] Int. Cl.[6] ..... E05F 15/16; H01H 3/16

[52] U.S. Cl. ..... 318/468; 318/266; 318/286; 318/460; 49/27

[58] Field of Search ..... 318/16, 626, 651, 652, 318/127, 128, 255, 256, 264, 265, 266, 275, 286, 460, 466, 467, 468, 488; 49/26, 27, 28; 307/112, 119

[56] References Cited

U.S. PATENT DOCUMENTS

| | | | |
|---|---|---|---|
| 3,315,050 | 4/1967 | Miller . | |
| 3,641,425 | 2/1972 | Cutler et al. . | |
| 3,696,359 | 10/1972 | Ross et al. . | |
| 3,781,836 | 12/1973 | Kruper et al. . | |
| 3,962,553 | 6/1976 | Linder et al. . | |
| 4,273,974 | 6/1981 | Miller . | |
| 4,916,439 | 4/1990 | Estes et al. . | |
| 4,924,214 | 5/1990 | Hill . | |
| 5,057,819 | 10/1991 | Valenti . | |
| 5,142,822 | 9/1992 | Beckerman | 49/27 |
| 5,157,230 | 10/1992 | Blubaugh . | |
| 5,191,268 | 3/1993 | Duhame . | |
| 5,203,110 | 4/1993 | Hörmann . | |
| 5,239,146 | 8/1993 | Blubaugh . | |

*Primary Examiner*—Bentsu Ro

*Attorney, Agent, or Firm*—Harness, Dickey & Pierce

[57] ABSTRACT

An improved door edge safety sensor for use with an automatic door operator which uses a motor to move a door between open and closed conditions with a controller for controlling operation of the motor and, an improved sensor comprising a tactile obstruction detector for generating a safety signal, a door vibration detector for detecting movement of the door, a safety signal transmitter operable in response to detected door motion, and control electronics which monitor the obstruction detector and the vibration detector and direct the signal transmitter to reverse the motor upon the door engaging an obstruction which reverses the door to an upward direction.

6 Claims, 3 Drawing Sheets

MONITORED RADIO FREQUENCY DOOR EDGE SENSOR

FIELD OF THE INVENTION

This invention relates to obstruction detectors for automatic door operators such as those used for garage doors, and more particularly to an improved door edge sensor which transmits status of the door edge to a door control mechanism in order to reverse the direction of a closing door when it contacts an obstruction.

BACKGROUND OF THE INVENTION

When implementing automatic door operators for opening doors such as garage doors, it is common to employ a motor which moves a door between opened and closed positions in response to control signals. Such control signals are typically generated by a portable radio frequency transmitter, and/or a wall mounted push button transmitter. Furthermore, techniques are provided for detecting door obstructions to prevent personal injury or property damage caused when the control door unintentionally closes on an object or person. Such obstruction detection prevents damage to the door as well as damage to the driving components which move the door. Furthermore, it is clear that a mechanically operated door poses a particular risk to children who are playing with the automatic garage door operator.

In one form, obstruction detection is performed by monitoring the tension of a drive chain interconnecting the motor with the door. Typically, the motor is coupled to the door with a chain or a screw drive mechanism. By mechanically linking the motor with the chain by a switch which is closed under normal conditions, but opened when the drive chain exceeds a predetermined amount, a switching effect can be provided for triggering the abortion of door operation. For example, a micro-controller is often used to detect such a switch state which aborts door operation when the switch is tripped to an open position. Typically, the micro-controller is programmed to stop the door when the switch is tripped while the door is opening, and stop the door and reverse its direction until it is fully opened when it detects an open switch while closing the door.

However, the aforementioned obstruction detectors provide only limited detection capability and are usually insufficiently sensitive to prevent all injuries. Therefore, attempts have recently been made to provide supplemental detection, as well as improve existing detection when sensing door obstruction. Furthermore, recent state regulatory authorities have proposed further stricter requirements which require additional obstruction detection. Such systems incorporate radiant obstruction detectors, generally using infrared or visible light, which is projected across a lower portion of the opening for a controlled door. By breaking or interrupting the radiant beam, an obstruction is detected and the automatic door operator can be directed to reverse or open up a door. An alternative additional obstruction detector utilizes a pressure sensitive strip disposed along a door's leading edge which is typically referred to as a safety edge switch. As the door is closed on an obstruction, pressure is detected on the safety edge switch which indicates the presence of an obstruction. However, these obstruction detectors require additional components, increase the cost of the systems, and require further additional power sources and electrical wiring, particularly when incorporating a switch on a door's leading edge.

SUMMARY OF THE INVENTION

A door edge safety sensor for use with an automatic door operator has a door-mounted tactile sensing switch for detecting a door edge obstruction, a door vibration detector for detecting movement of the door, a safety signal transmitter which sends a coded radio frequency transmission during movement of the door to the automatic door operator that indicates the unobstructed and obstructed status of the door, and battery powered control electronics for remotely powering the obstruction detector, vibration detector, safety signal, and control electronics. The control electronics monitor the status of the safety signal to determine the door obstruction status, and control the transmission of signals to the automatic door operator which determines obstruction of the door and triggers reversal of door motion to an open position. In a preferred embodiment, the tactile sensing switch is formed from a set of parallel conducting strips separated by a compressible insulating foam strip such that compression of the foam strip provides a conduction path between the conducting strips which varies the voltage therebetween as a result of variation of resistance across the strips. Furthermore, the vibration detector is preferably a piezoelectric element which detects movement of the door and initiates operation of the signal transmitter that wakes up the control electronics, including a microprocessor, such that the transmitter transmits a "heart-beat" signal indicating the obstruction status for the door's tactile sensing switch.

The automatic door operator receives the "heart-beat" signal while opening and closing, but only utilizes the signal while the door is closing wherein detection of the regular heart-beat signal is necessary to continue downward motion of the door. As a result, detection of a door obstruction by the tactile sensor interrupts the heart-beat signal which triggers a reversal of the motor and opening of the door under direction of the automatic door opener. When the automatic door operator fails to detect the active safety signal, or heart-beat signal, the omission is interpreted by the automatic door operator as an obstruction. Furthermore, an open or short of the two conducting strips is detected as a system failure or obstruction, respectively. Additionally, the supplemental obstruction detector is only employed while closing the door. Hence, the signal from the tactile sensing switch is ignored during door opening.

The controller includes a further provision which allows for manually overriding the obstruction signal to close a door when the tactile sensor is malfunctioning. By constantly depressing the local push button, the obstruction detector is overridden which allows one to close the door.

Objects, features and advantages of this invention are to provide a door edge safety sensor which is self contained and battery powered, lightweight, small and compact, self-supporting, rugged, durable, waterproof, readily and easily packaged in a door edge, quickly and easily repaired and maintained, and is of a simplified design and is easy and economical to manufacture, assemble and install.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
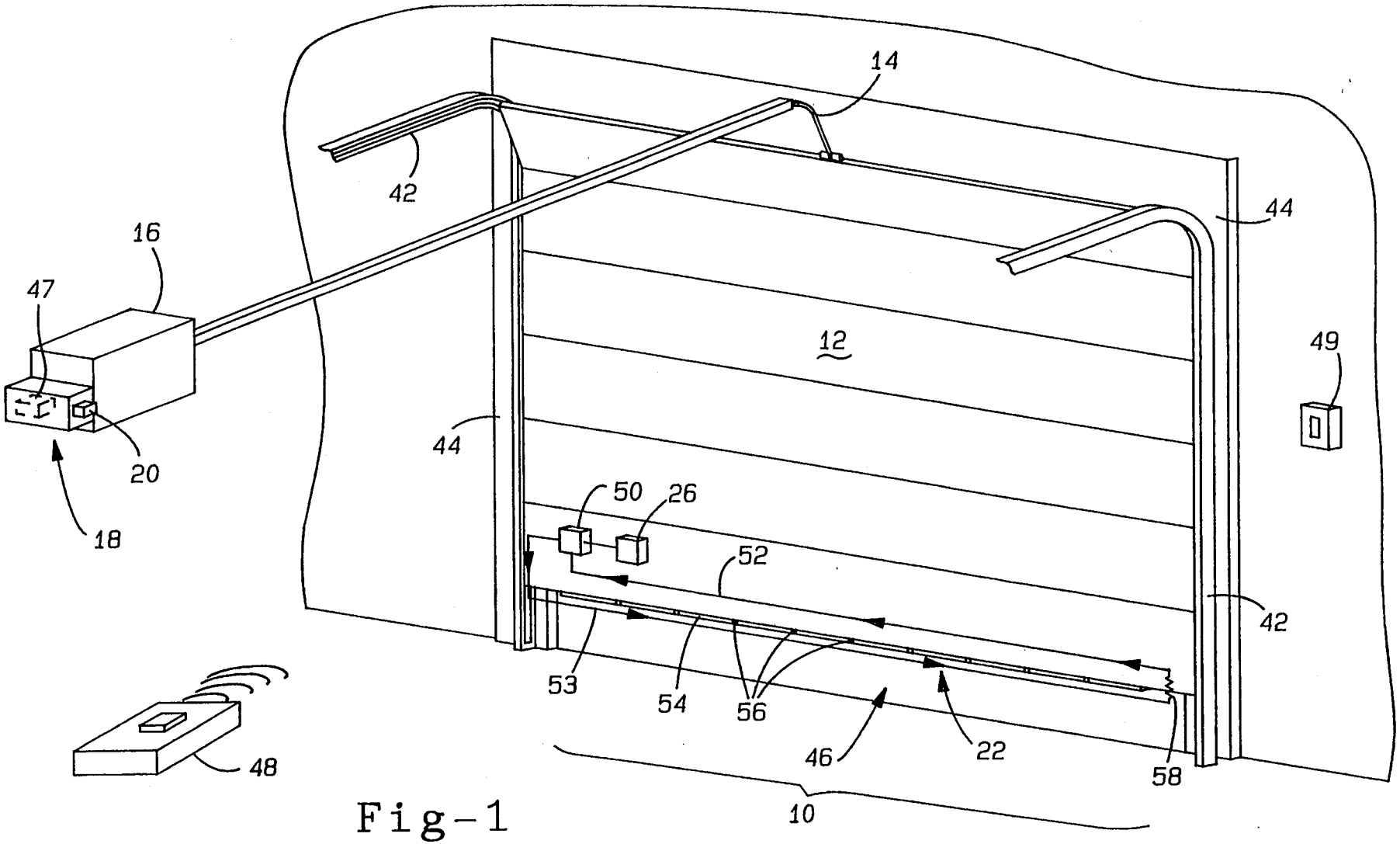
FIG. 1 is a functional representation of the radio frequency edge monitoring system of the present invention provided on an automatic garage door.
Figure 2:
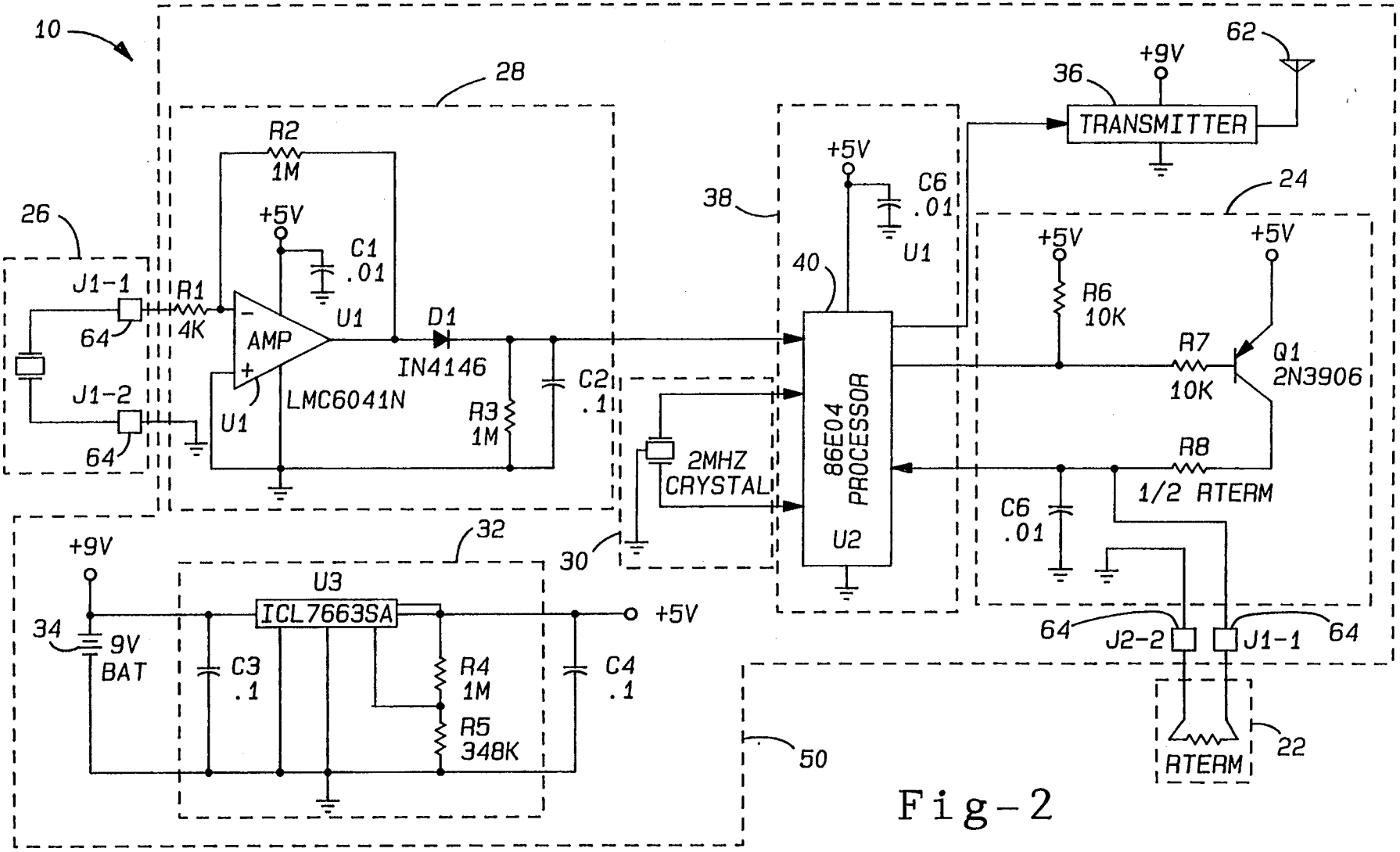
FIG. 2 is a schematic block diagram illustrating the wireless safety edge transmitter of FIG. 1.

Referring in more detail to the drawings, FIG. 1 illustrates a door edge safety sensor 10 of this invention mounted on the lower edge of an overhead garage door 12. The door is moved between open and close positions through a drive chain 14 by a motor 16 in response to commands from a garage door control mechanism 18 which together form an automatic garage door operator. The door edge safety sensor 10 detects the presence of obstructions in a door path during closing which is transmitted to a radio receiver 20 provided on the garage door control mechanism such that motion of the door is reversed to an open direction upon sensor contact with an obstruction. As shown in FIG. 2, the safety sensor 10 includes a tactile obstruction detector, in this case a sensing switch 22 for detecting door edge contact with an obstruction, a comparator circuit 24 for comparing unobstructed and obstructed states of the sensing switch 22, a door vibration detector, or sensor 26, an amplifier/integrator circuit 28 for conditioning sensed vibration signals, an oscillator or clock 30 for timing operation of the safety sensor 10, a linear regulator 32 which conditions power supply to the sensor from a battery source 34, a transmitter 36 for transmitting status of the safety sensor 10 to radio receiver 20, and a microprocessor 40 having accompanying software for directing operation of the safety sensor 10. The amplifier/integrator circuit 28, clock 30, regulator 32, transmitter 36, microprocessor 40 and, comparator circuit 24 form control electronics which define a radio frequency (RF) monitoring circuit 50.

An overhead garage door 12 incorporating the door edge safety sensor 10 of this invention is preferably constructed from a plurality of hinge-connected sectional panels which travel on a pair of linear guides 42 along a door frame 44 such that raising of the door defines an opening 46. Alternatively, the sensor of this invention can be implemented on one-piece garage doors which are raised on substantially vertical guides, or which are mounted on a suspension mechanism which generally lifts the door and outwardly rotates and translates the leading edge of the door in relation to the door opening. In these alternative applications, placement of the safety sensor 10 might be slightly modified in order to assure detection of any obstructions present within the opening 46. The principal concern during operation of each of these embodiments is the accurate and responsive detection of obstructions in the path of a door while it is closing through an opening 46. For example, obstruction of the door opening by a vehicle, a child's toys, or even a child necessitates a quick and accurate detection of the obstruction in order to assure that the closing door does not damage the obstruction or that the door is not damaged. Furthermore, it is desirable to enhance the reliability and durability of such a sensing system by eliminating unnecessary wiring which is susceptible of wear and loss of electrical conductivity. Accordingly, the door edge safety sensor 10 of this invention is intended to be responsive to contact with door obstructions throughout its entire closure cycle, and to provide such detection with a remotely mounted sensor which eliminates the necessity of electrically wiring the sensor to the garage door control mechanism 18.

The door edge safety sensor 10 of this invention which is depicted in FIG. 1 is utilized with a garage door control mechanism 18 whose construction and operation are presently understood in the art, and which is further detailed in U.S. Pat. No. 5,191,268 which is assigned to the same Assignee as the present application, and is hereinafter incorporated by reference. Generally such garage door control mechanisms utilize the radio receiver 20 in conjunction with the control mechanism to operate the motor 16 which opens and closes an overhead garage door 12. Typically, a remote radio frequency transmitter 48 is provided which allows a user to remotely open and close a garage door from within a vehicle, and additionally a wall-mounted auxiliary transmitter unit 49 is provided which allows a user to open and close the garage door from within a garage. Likewise, a failure mode provision is provided such that hold down of either transmitter's trigger button allows for override opening, or closing of the door by maintaining depression of the button. The control mechanism 18 is provided with a microprocessor 47 which directs receipt of transmissions from the radio receiver 20 and furthermore identifies a particular remote transmitter in order to enable authorized door opening and closing. Further details are provided in the aforementioned patent. In order to comprehend operation of the present door edge safety sensor 10 of this invention, it is sufficient to understand that the control mechanism microprocessor 47 has separate additional software subroutines which identify and receive sensor status signals from the safety sensor 10 in conjunction with the radio receiver 20 for actuating opening and closing of the door 12. Alternatively, a further additional receiver can be provided on the control mechanism 18 for separately receiving the safety sensor signals. However, such implementation would increase the number of parts as well as the cost, and would require two separate paths of communication for making decisions when activating motor 16.

The opening and closing of overhead garage door 12 is typically directed by the garage door control mechanism 18 in response to signals received from the remote transmitting unit 48 such that radio receiver 20 receives the signals and control mechanism 18 directs motor 16 to activate opening or closing of the door.

As depicted in FIG. 1, the door edge safety sensor 10 is carried on the bottom edge of a garage door 12 by mounting the elongate sensing switch 22 along the door's bottom edge, and by further carrying the remaining portion of the sensor, namely a radio frequency monitoring circuit 50 and vibration sensor 26 adjacent the switch along the base of the door. Alternatively, the monitoring circuit and vibration sensor can be provided in a receptacle within a bottom panel of the door. Preferably, the monitoring circuit and vibration sensor are positioned proximate the sensing switch in order to decrease the length of wire required to form interconnection therebetween, and to decrease signal transmission time correspondingly.

Preferably, the sensing switch 22 is constructed from a pair of substantially parallel conductive strips 52 and 53 separated by a non-conductive compressible foam strip 54. A plurality of spaced apart through-holes 56 are formed in the foam strip to provide a path for electrical interconnection between the conductive strips such that when the foam strip is compressed by an obstruction, the conductive strips move together and provide a conductive path between the conductive strips via the through-holes. Furthermore, an end of line resistor electrically interconnects an end of each conductive strip opposite the end where they are connected to the monitoring circuit 50. In its unobstructed state, sensing switch 22 provides a resistance substantially from an end of line (EOL) resistor 58 which is monitored by the RF monitoring circuit 50. Preferably, the end of line resistor 58 is a fixed known resistor, for example, 470Ω. When the door edge comes into contact with an obstruction, the pair of conductive strips 50 and 53 are brought together which shorts out the resistor 58 such that resistance across the strips is substantially modified and is, in fact, substantially nullity if the path between the strips is a perfect conductor. Even if a resistance is still present, the difference in resistance between the shortened and unobstructed states is detectable by the monitoring circuit.

As depicted in FIG. 2, the radio frequency monitoring circuit 50 comprises substantially the control electronics, namely circuits 24 and 28, clock 30, regulator 32, transmitter 36, and microprocessor 40 which communicates with the sensing switch 22, battery supply 34, and vibration sensor 26.

The battery source 34 provides a power supply directly to the radio frequency monitoring circuit 50, and indirectly to the vibration sensor 26 and sensing switch 22. As shown in FIG. 2, the battery source 34 also provides a conditioned supply of power via linear regulator 32 which decreases threshold voltage from 9 volts down to 5 volts. Such reduced voltage supply is provided to the microprocessor 40, transistor 60 and across biasing resistor R6 resident in comparator circuit 24, and furthermore to amplifier U1 resident in the amplifier/integrator 28. Preferably, the transistor 60 is a PNP common emitter small signal transistor generally designated by the part No. 2N3906, and referenced as Q1 in FIG. 2. Finally, battery source 34 provides power supply to transmitter 36 such that safety sensor status signals are transmitted through an antenna 62 resident on the monitoring circuit 50 which directs motor control actuation of the door between open and close positions. The antenna 62 is preferably a piece of wire forming a radio frequency transmitter loop which provides radiating means for transmitting radio frequency signals to the nearby radio receiver 20. Preferably, power is furnished by a single standard 9.0 volt (transistor) alkaline battery, namely battery source 34. In conjunction with the battery, the linear regulator shall provide stepped down voltage supply in various components of the safety sensor 10. Preferably, the linear regulator is a HARRIS ICL 7663SA, generally designated as U3 in FIG. 2. The battery life shall be two years with an average of six open-closed door cycles per day, over a 365 day year.

Preferably, the vibration sensor 26 is formed from a piezoelectric element which is preferably connected with the monitoring circuit 50 through a pair of pin connectors 64. Output from the vibration sensor 26 is then amplified and conditioned, namely integrated, with an operational amplifier, namely U1, coupled with a small signal diode, D1. As a consequence, door motion vibrations which are sensed by the vibration sensor 24 are conditioned by the amplifier/integrator circuit 28 where they are input into the microprocessor 40. The amplified signal which arrives at the microprocessor is analyzed, and any output in excess of 40mVp-p (peak-to-peak) shall initiate the transmitter operation under the direction of the microprocessor 40. Such analysis and direction is provided by software within the microprocessor. The vibration sensor detects door motion and in response to a predetermined magnitude of signal, provides an amplified wake-up signal to the control electronics 38, namely microprocessor 40, which keeps the microprocessor awake, or active, during the door movement. The resulting voltage signal is provided to the microprocessor both during the up and down movements of the door. Preferably, a 2MHz crystal is utilized. Furthermore, operational amplifier U1 is preferably a National Semiconductor device No. LMC6041N, and small signal diode is preferably a 1N4148 diode, as designated by D1 in FIG. 2. Upon initiation, the transmitting device shall monitor the sensing edge periodically at the rate of slightly less than 3 times per second for the presence of the end of line (EOL) resistor 58 within the nominal value ±20%, ie., 470Ω±94Ω (typical). Alternatively, other values for the EOL resistor may be selected which conserve battery life and which are consistent with the sensing edge leakage resistance values inherent therein.

As shown in FIG. 2, the control electronics of the monitoring circuit 50 are substantially formed from the microprocessor 40 which is provided with control software for communicating with the various components coupled with the microprocessor in the safety sensor of this invention. Preferably, the microprocessor is an 86EO4, as designated by U2 in FIG. 2. As mentioned supra, the microprocessor is preferably embodied in a microprocessor circuit having read/write random access memory and a control program fixed in read only memory for directing such communication as well as receipt and transmission of data between accompanying components therebetween.

The transmitter 36 is preferably a fixed mounted, battery-powered digital UHF remote control transmitter, which is coupled with the micro-processor on the monitoring circuit 50 and which is further enclosed within a plastic case in conjunction with the vibration sensor 26. The plastic case is then either mounted to the base of a garage door, or is inserted within a recess near the base of the door. The transmitter emits a radio frequency (RF) signal which is pulse width modulated with a digital pulse train compatible with the garage door control mechanism, namely the garage door operator (GDO) receiver 20. During transmission, a light emitting diode (LED) which is provided on the case indicates whether current is being consumed by the radio frequency transmitter portion of the control electronics with the monitoring circuit 50, i.e. preferably a Printed Circuit Board (PCB) assembly. The LED illumination does not indicate remaining battery life, but instead indicates whether the transmitter is in an operating mode. Alternatively, the LED can be further provided to indicate a low battery condition. Furthermore, the transmitter is powered by the standard 9 volt "transistor" alalkaline battery mentioned supra. Additionally, the transmitter shall have operating specifications with a battery voltage of between 4.5 to 10 volts. Furthermore, the carrier frequency will preferably be adjusted to 31 0.0 MHz ±1.0 MHz at 23° C, and the radio range of the transmitter shall be 75 feet minimum, open-air, using the standard 4–6 μ volt receiver.

Figure 3:
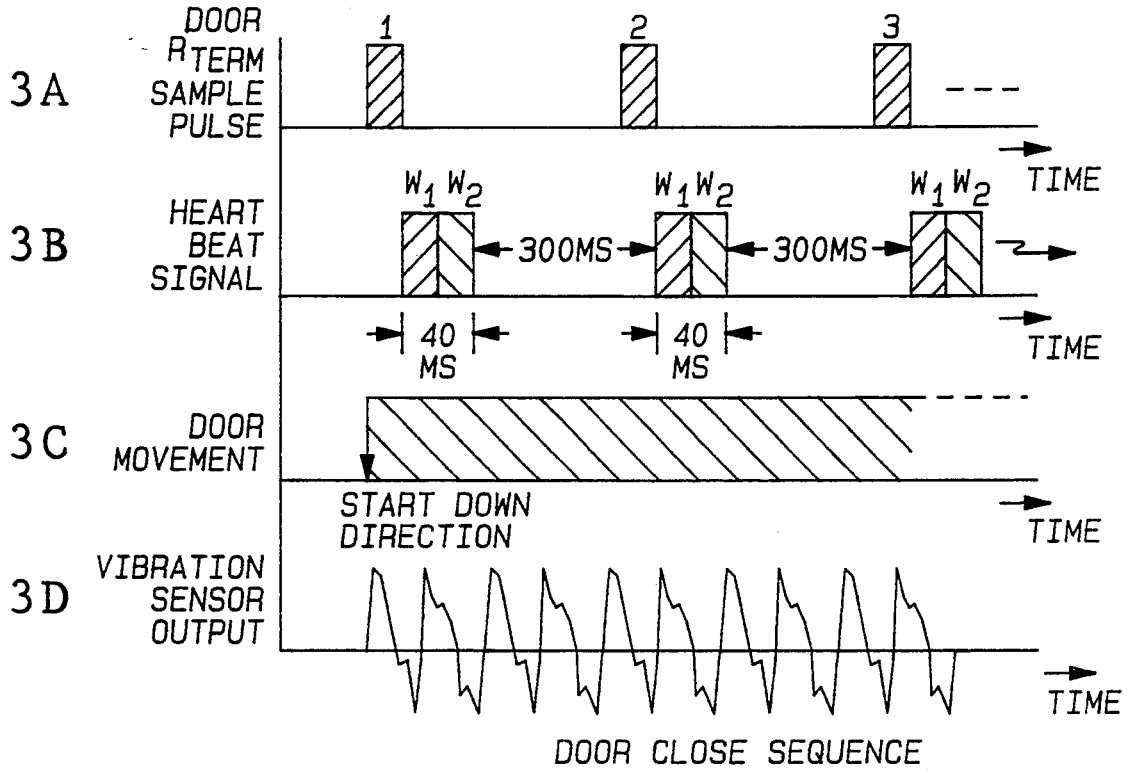
FIG. 3 is a timing diagram illustrating examples of various signals resulting during a normal closing operation of the present invention.

In operation, door motion is sensed by vibration sensor 26 which turns on the transmitter 36 to transmit a "heart-beat" signal $W_1$ $W_2$ for a period of not less than 20seconds and not more than 30 seconds. As shown in FIG. 3, upon sensing of door motion by vibration sensor 26, microprocessor 40 is turned on and monitoring circuit 50 with transmitter 36 are initiated such that the transmitter transmits the "heart-beat"signal to the garage door radio receiver 20. As shown in FIG. 3A, the "awakened"microprocessor 40 directs sampling of the EOL resistor 58 such that a series of sample pulses are applied to the series connection formed by resistor 58 and an internal resistor R8 formed in comparison circuit 24. With known values for the applied sensing voltage, the resistor R8, and resistor 58, the voltage can be calculated and predicted. The comparison circuit 24 applies and sources the sampling voltage to resistor R8 and the EOL resistor 58 such that the comparison circuit compares the voltage at respective junctions for R8 and the EOL resistor to a known reference value set by the circuit. FIG. 3 shows typical timing for the successive measurements of the EOL resistor 58.

The resistor sample pulses shown in FIG. 3A are typically taken every 300 microseconds, or slightly less than 3 times a minute. As such, when the door movement begins a resulting vibration sensor output breaks up the microprocessor which generates the resistor sample pulses of FIG. 3A which have a magnitude of $E_{ss}$ which is then applied to the series combination of $R_8$ and the EOL resistor by comparison circuit 24.

The voltage at the junction of the $R_8$ and EOL resistors is calculated by a simple voltage divider formula as follows:

$$V_{REOL} = \frac{V_{SS} \times R_{EOL}}{R_8 + R_{EOL}}$$

where $V_{REOL}$ will vary in accordance with resistor tolerances and conditions of the edge material. However, an acceptable "window" in $V_{REOL}$ can be determined such that $V_{REOL}\pm$ tolerance for the test of the strip status, either "open" or "shorted" due to an obstruction of the door travel or an open conducting strip 52 or 53. After downward movement of the door begins, a pair of back to back encoded word transmissions $W_1$ and $W_2$ are transmitted to the radio receiver 20 in a spaced apart pulsed manner such that $W_1$ and $W_2$ provide a 40 microsecond duration back to back, and then each pair of $W_2$ $W_2$ pulses are spaced apart 300 Milliseconds, as depicted in FIG. 3B. Once downward movement of the door has begun, as shown in FIG. 3C, successful reception of the two encoded word transmission $W_2$ and $W_2$ is required in order to continue movement of the door in the downward direction. Such requirement is provided in software of the microprocessor resident in the garage door control mechanism 18, and is typically provided in RAM. Presence of a missing heartbeat signal, namely pulse $W_1$ $W_2$, will cause the door travel to stop and reverse to the full open position. As shown in FIG. 3D, a typical vibration sensor output is provided for a moving garage door.

The garage door control mechanism 18 receives the "heartbeat" pulse $W_1$ $W_2$as shown in FIG. 3B through radio receiver 20 such that its motor control electronics check for the presence of the heartbeat signal for a minimum of one pulse every second. Transmission of this heartbeat signal at the rate of 300 microseconds assures at least three such sample pulses are delivered per second. Therefore, if radio interference is encountered, duplication of the $W_1$ $W_2$ heartbeat message will tend to prevent false obstruction, resulting in inadvertent door reversals.

Figure 4:
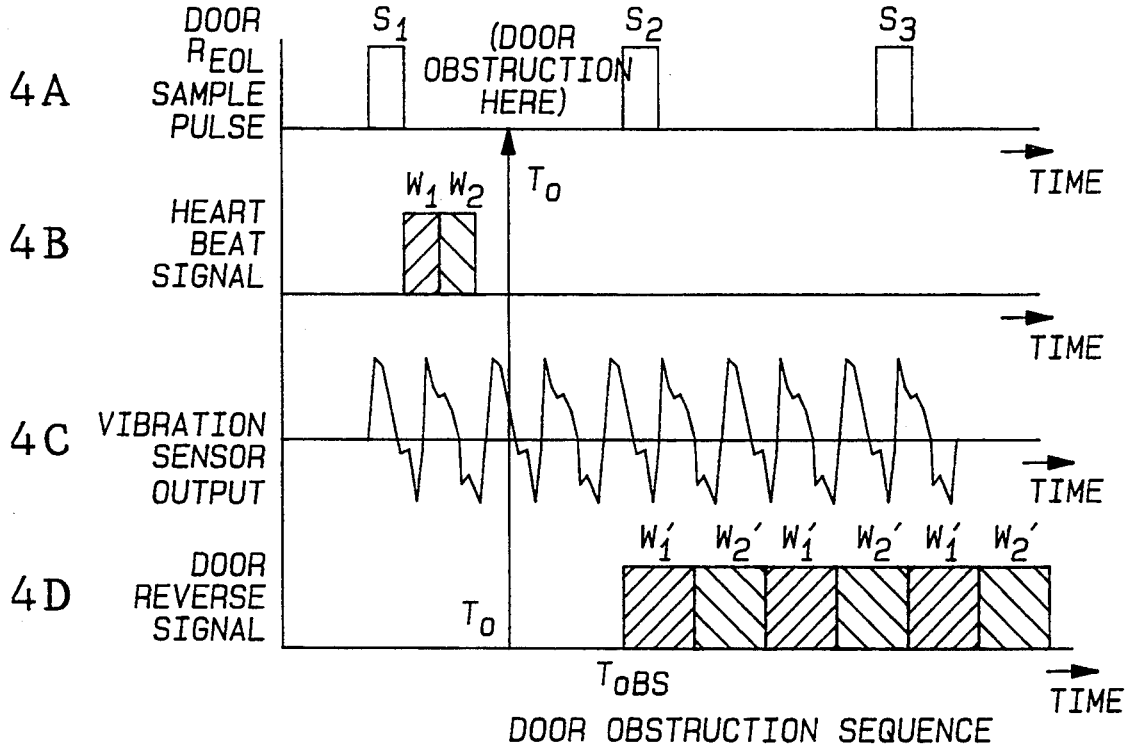
FIG. 4 is a timing diagram illustrating an example of various signals resulting during an obstruction sequence of the present invention.

FIG. 4 depicts the corresponding signal transmissions for a door obstruction sequence which corresponds to those signals depicted in FIG. 3 for an unobstructed door. FIG. 3A shows the sample pulses for EOL resistor 58, and time line $T_O$ indicates the occurrence of a door obstruction. FIG. 3B shows termination of the heartbeat signal $W_1$ $W_2$ after the obstruction at $T_0$. As a result, the garage door control mechanism 18 will no longer receive the heartbeat signal, such that after a maximum one second delay, the downwardly moving door is reversed in direction until it is fully opened.

Alternatively, FIG. 3D depicts a variation for the garage door control mechanism 18 which requires receipt of a separate heartbeat pulse, namely $W_1'W_2'$ which is repeatedly transmitted in nested back to back arrangement subsequent to detection of a door obstruction at $T_0$. In this alternative version, contact of an obstruction with the safety sensor 10 produces a reversal "heartbeat signal" which is separate from the heartbeat signal of the previous embodiment, and which can immediately respond within a pulse with duration of a single heartbeat to produce a transmitted obstruction command to the control mechanism 18 which more quickly reverses the door's direction.

As shown by the signal transmissions in FIG. 4, at time $T_o$, an obstruction compresses the safety sensor 10 such that an error condition is subsequently developed by comparator circuit 24 which results in an error level voltage for $V_{REOL}$ at a later time $T_{OBS}$, defined by the pulse sample size delay, a continuous sequence of error "words" of the $W_1'$ and $W_2'$ are generated back to back to form an error "heartbeat" which is transmitted via transmitter 36 to the radio receiver 20 in order to reverse the motion of the door motor 16 and open the door. Upon proper signal processing of a minimum of one $W_1'W_2'$ sequence, the door travel is stopped and reverse to the open direction. Thus, the approximate minimum time to reversal is defined by the time between successive "reversal heartbeat" timing pulses, or the width of one $W_1'W_2'$sequence plus any additional delay parameter.

In the case for the FIG. 4 embodiment, where radio frequency interference causes improper reception of either an error signal or the error "heartbeat signal"$W_1'$ $W_2'$ at a worse case, the door travel will stop and reverse within approximately one width of false sequences.

Further provision is made with the preferred embodiment of this invention for constant contact mode operation for downward direction travel or door closure with the previously mentioned external radio transmitter commonly utilized on devices in this art. In the event that a fault condition is present, for example a dead battery or a faulty sensor strip 52 or 53, the safety sensor 10 fails to transmit the "heartbeat"signal, and therefore a means must be provided to close an open door. In this case, a stationary, or permanently mounted, non-portable radio transmitter typically mounted on a wall switch control 49, is incorporated for effectuating closure of the door. This mode of operation is referred to in the industry as a "constant contact"condition for door closure, and is referred to in Underwriters Laboratory UL-325. Momentary contact from a wall switch or stationary switch, or a handheld portable transmitter, or a wall mounted transmitter, will not cause an open door to close. However, constant contact provides an override means for closing the door.

It is to be understood that the invention is not limited to the exact construction illustrated and described above, but that various changes and modifications may be made without departing from the spirit and scope of the invention as defined in the following claims.

I claim:

1. A door edge safety sensor for use with an automatic door operator having a motor coupled for moving a door between open and closed conditions to cover an opening and a controller for controlling operation of the motor corresponding to command signals, the sensor comprising:

a tactile obstruction detector for generating a safety signal;

a door vibration detector for detecting movement of the door between the opened and closed positions;

a safety signal transmitter operable in response to detected door movement to provide a coded radio frequency transmission for receipt by the automatic door operator such that the transmission varies between a first and second state corresponding with an active and deactive state, respectively, of such safety signal; and control electronics with provision for a battery power supply electrically communicating with said obstruction detector, said vibration detector, and said signal transmitter and operable between a waiting and active state in response to said vibration detector detecting door movement, said control electronics operable in such active state to monitor status of the safety signal from said obstruction detector;

wherein said control electronics interrupt the transmission from said safety signal transmitter in response to said tactile obstruction detector detecting an obstruction and generating a safety signal indicative thereof, such that in response thereto the automatic door operator reverses the motor which moves the door to a fully open condition.

2. The door edge safety sensor of claim 1 wherein said safety signal transmitter provides a first state comprising said coded radio frequency transmission during movement of the door while in an unobstructed state.

3. The door edge safety sensor of claim 2 wherein said safety signal transmitter provides a second state comprising termination of such coded radio frequency transmission during movement of the door upon reaching a detected obstructed state.

4. The door edge safety sensor of claim 1 wherein said door vibration detector is a piezoelectric element.

5. The door edge safety sensor of claim 1 wherein said door vibration detector is an accelerometer.

6. The door edge safety sensor of claim 1 wherein said control electronics comprise a microprocessor in electrical communication with said door vibration detector and said safety signal transmitter to receive respective signals therefrom, said signal transmitter operable in response to control directives via said microprocessor for transmitting such coded radio frequency transmission to the automatic door operator.

* * * * *